United States Patent [19]

Owens et al.

[11] Patent Number: 4,785,145

[45] Date of Patent: Nov. 15, 1988

[54] MODULAR ELECTRICAL DISCONNECT SWITCH

[75] Inventors: Robert L. Owens, Southington; Paul D. Carpenter, Vernon, both of Conn.

[73] Assignee: General Electric Company, New York, N.Y.

[21] Appl. No.: 135,789

[22] Filed: Dec. 21, 1987

[51] Int. Cl.[4] ..... H01H 1/42

[52] U.S. Cl. ..... 200/162; 200/280; 200/255

[58] Field of Search ..... 200/280, 281, 162, 255, 200/144 R

[56] References Cited

U.S. PATENT DOCUMENTS

| | | | |
|---|---|---|---|
| 3,211,867 | 10/1965 | Heft | 200/144 R |
| 3,424,882 | 1/1969 | Stokes | 200/67 R |
| 3,575,566 | 4/1971 | Rys | 200/162 |
| 3,917,920 | 11/1975 | Pekrul et al. | 200/162 |
| 4,365,129 | 12/1982 | McKee | 200/162 |
| 4,628,163 | 12/1986 | Mori et al. | 200/144 R |
| 4,675,481 | 6/1987 | Markowski et al. | 200/144 R |

FOREIGN PATENT DOCUMENTS

| | | | |
|---|---|---|---|
| 678007 | 1/1964 | Canada | 200/162 |
| 168741 | 9/1921 | United Kingdom | 200/255 |

*Primary Examiner*—Renee S. Luebke

*Attorney, Agent, or Firm*—Richard A. Menelly; Walter C. Bernkopf; Fred Jacob

[57] ABSTRACT

A modular electrical disconnect switch employs multifunctional component designs for minimum inventory of operating components. The switch replaces a number of switches of different ratings and sizes thereby reducing the total switch inventory requirements.

8 Claims, 3 Drawing Sheets

MODULAR ELECTRICAL DISCONNECT SWITCH

BACKGROUND OF THE INVENTION

Simple electric disconnect switches consisting of a pair of separable contacts that are operated on by means of an operating mechanism under the control of a pair of powerful overcenter operating springs are described within an early U.S. Pat. No. 3,424,882. To maintain electrical connection when a contact blade and blade receivers are substituted for the contacts, a contact clip such as that described within U.S. Pat. No. 3,917,920 is employed. U.S. Pat. No. 4,675,481 entitled "Compact Electric Safety Switch" describes the advanced state of the art of disconnect switches employing a contact blade driven by a pair of powerful operating springs.

With the rising cost of the ferrous and non-ferrous metals required within electric disconnect switches, it is imperative for U.S. manufacturers to reduce the number of inventoried switch component parts to remain competitive with offshore switch manufacturers.

One purpose of the instant invention is to describe an electric disconnect switch that multi-functionally employs common components for the line and load terminal assemblies to reduce the number of parts that must be inventoried by the switch manufacturer.

A further purpose of the instant invention is to describe a multi-rated electric disconnect switch that meets the electrical requirements of a number of separate electric disconnect switches. The multiple rating reduces the different types of switches that must be inventoried to meet the electric switch industry requirements.

SUMMARY OF THE INVENTION

The invention comprises an electric disconnect switch wherein a pivotal contact blade and blade receiver design meet the electrical requirements of several types of separate electric disconnect switches. A T-shaped lug adapter design multi-functionally fits within both line and load subassemblies.

DESCRIPTION OF THE PREFERRED EMBODIMENT

Figure 1:
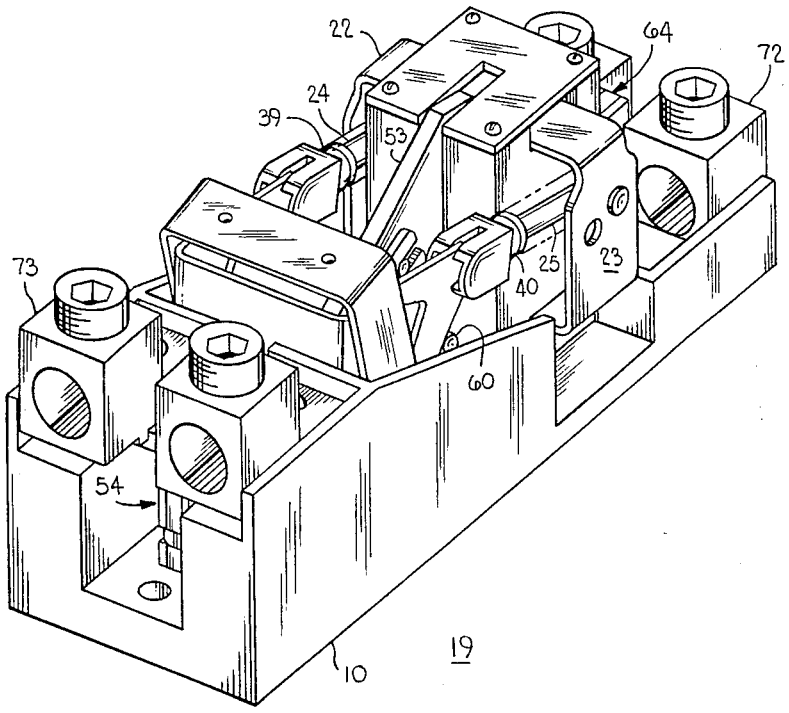
FIG. 1 is a top persective view of the electric switch assembly according to the invention.

The disconnect switch 19 according to the invention is shown in FIG. 1 to include a molded plastic support base 10. The current path through the switch includes a pair of load lugs 73 supported on the base by means of a blade carrier 54 and a contact blade 53 which connects the line lugs 72 through a blade receiver 64. The contact blade connects with a pair of mechanism side frames 22, 23 by means of a pivot pin 60 and pivot arms 24, 25. The side frames in combination with pivot arms 24, 25 and operating springs 39, 40 constitute the "operating mechanism" for lifting the contact blade 53 out of the blade receiver 64 to interrupt the current path between the load and line lugs 73, 72.

Figure 2:
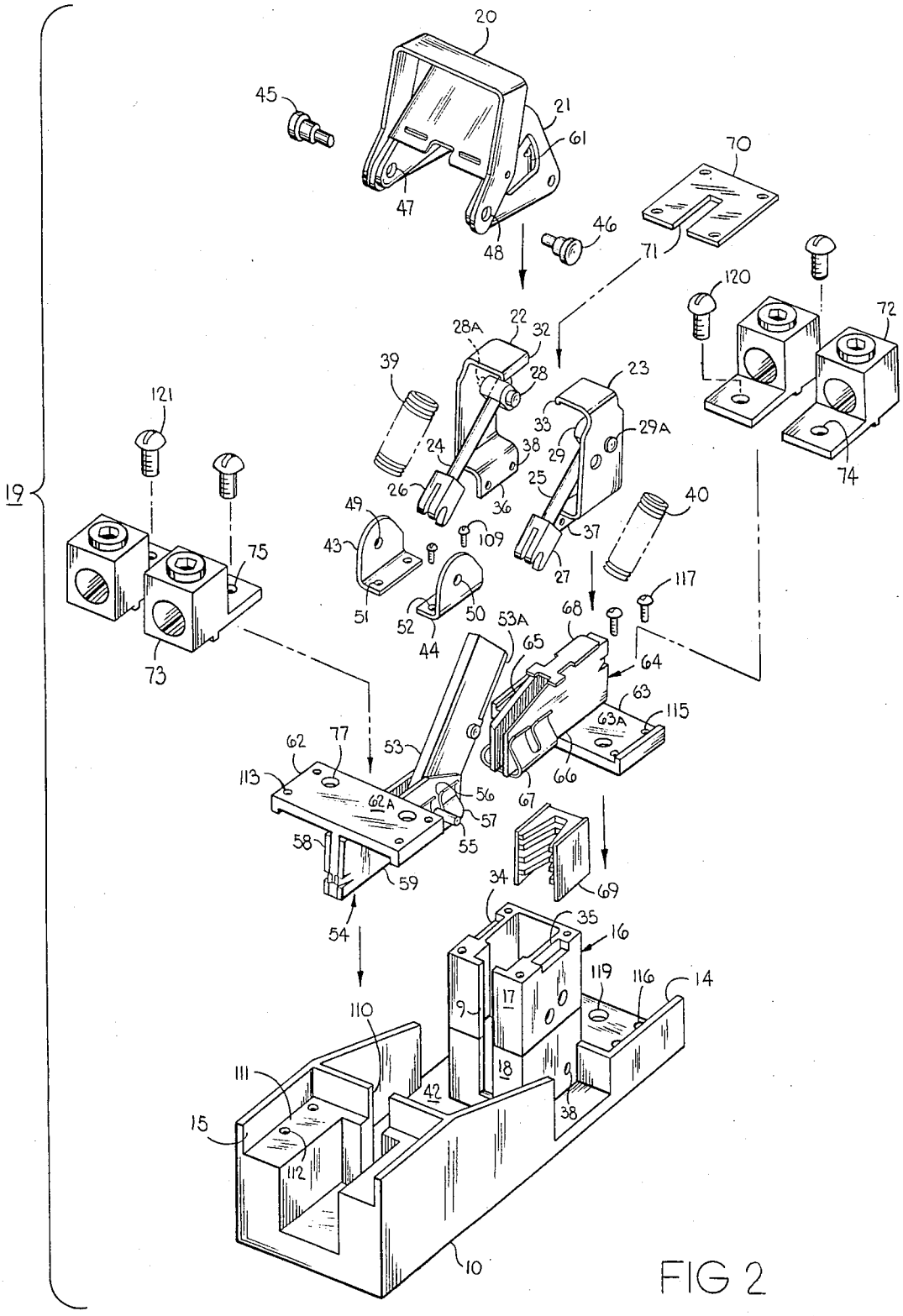
FIG. 2 is a top perspective view of the switch assembly in FIG. 1 with the components arranged in isometric projection.

The switch 19 is assembled in the manner depicted in FIG. 2 wherein the base 10 is formed from a single molding operation wherein the load lug compartment 15 and line lug compartment 14 are integrally formed upstanding from a planar bottom member 42. Also integrally formed with the base 10 is the blade receiver compartment 18 to which a separate arc chamber 17 is attached. A continuous blade clearance slot 9 is formed through both the arc chamber and the blade receiver compartments. Besides containing a part of the blade receiver 64, within the blade receiver compartment 18 and the arc chute assembly 69 within the arc chamber 17, the operating mechanism support 16 carries the side frames 22, 23 which are attached thereto by means of thru-holes formed within their bottom offset ends 36, 37 and threaded holes 38 formed within the bottom of the pivot support 16. The curved upper ends 32, 33 of the side frames 22, 23 are captured within a corresponding pair of grooves 34, 35 formed on the top surface of the pivot support 16. The pivot pins 28, 29 pivotally support the spring guide arms 24, 25 and are in turn captured within the side frames by means of the pivot pin ends 28A, 29A. A pair of powerful operating springs 39, 40 are captured between the yokes 26, 27 formed on one end of the arms 24, 25 and the pivot pins 28, 29 extending through an opposite end thereof. The handle yoke 20, angled connector 21 and yoke plate 61 are pivotally attached to the bottom 42 by means of brackets 43 which are fixedly attached to the bottom by means of thruholes 51, 52 and self-tapping screws 109. The handle yoke 20 is pivotally attached to the brackets 43, 44 by means of thru-holes 47, 48 formed through the handle yoke 20, yoke plate 61, angled connector 21, and thru-holes 49, 50 formed within the brackets, all by means of pivot pins 45, 46. The blade carrier 54 includes a pair of side plates 58, 59 within which a T-shaped lug adapter 62 is inserted at one end and within which the contact blade 53 is inserted at an opposite end thereof. The contact blade is pivotally retained within the side plates 58, 59 by the insertion of a pivot pin 55 through a slot 56 which extends through both of the side plates. The blade carrier 54 extends through the slot 110 such that the horizontal part 62A of the T-shaped lug adapter 62 seats on the platform 111 integrally formed within the load lug compartment 15 and is attached thereto by means of thru-holes 113 extending through the T-shaped lug adapter and thru-holes 112 formed within the platform 111. To insure good electrical connection between the contact blades 53 the side plates 58, 59 a contact clip 57 is positioned over the side plates. The clip is similar to that described within the aforementioned U.S. Pat. No. 3,917,920. The contact blade 53 extends through the slot 9 provided within the operating mechanism support 16. The blade receiver 64 which includes a similar T-shaped lug adapter 63, positioned inverse to the earlier described T-shaped lug adapter 62, such that the horizontal part 63A rests on the bottom 42 and is secured thereto by means of screws 117, thru-holes 115 formed through the T-shaped lug adapter 63 and threaded openings 116 formed within the bottom 42. A contact clip 67 similar to the earlier described clip 57 is positioned around the side plates 65, 66 within the blade receiver 64 to insure good electrical connection between the edge 53A of the contact blade 53 when inserted between the side plates 65, 66. An arc runner 68 is positioned on top of the blade receiver 64 to interact with the arc which occurs when the edge 53A of the contact blade is separated from the blade receiver while the switch 19 is electrically energized. The arc runner directs the arc within the arc chute 69 positioned within the arc chamber 17 wherein the arc becomes extinguished. An insulative cover 70 is fastened to the top of the pivot support 16 to confine the arc within the arc chute 69 while allowing free movement of the contact blade 53 by means of clearance slot 71 formed therein. Once the blade receiver 64 is fastened to the bottom 42, a pair of line lugs 72 are fastened to the horizontal part 63A by means of thru-holes 74 formed through the line lugs 72, screws 120 and threaded openings 119. The load lugs 73 are attached to the blade carrier 54 by means of thru-holes 75 formed in the load lugs 73, threaded holes 77 formed in the horizontal part 62A of the T-shaped lug adapter 62 and screws 121.

Figure 3:
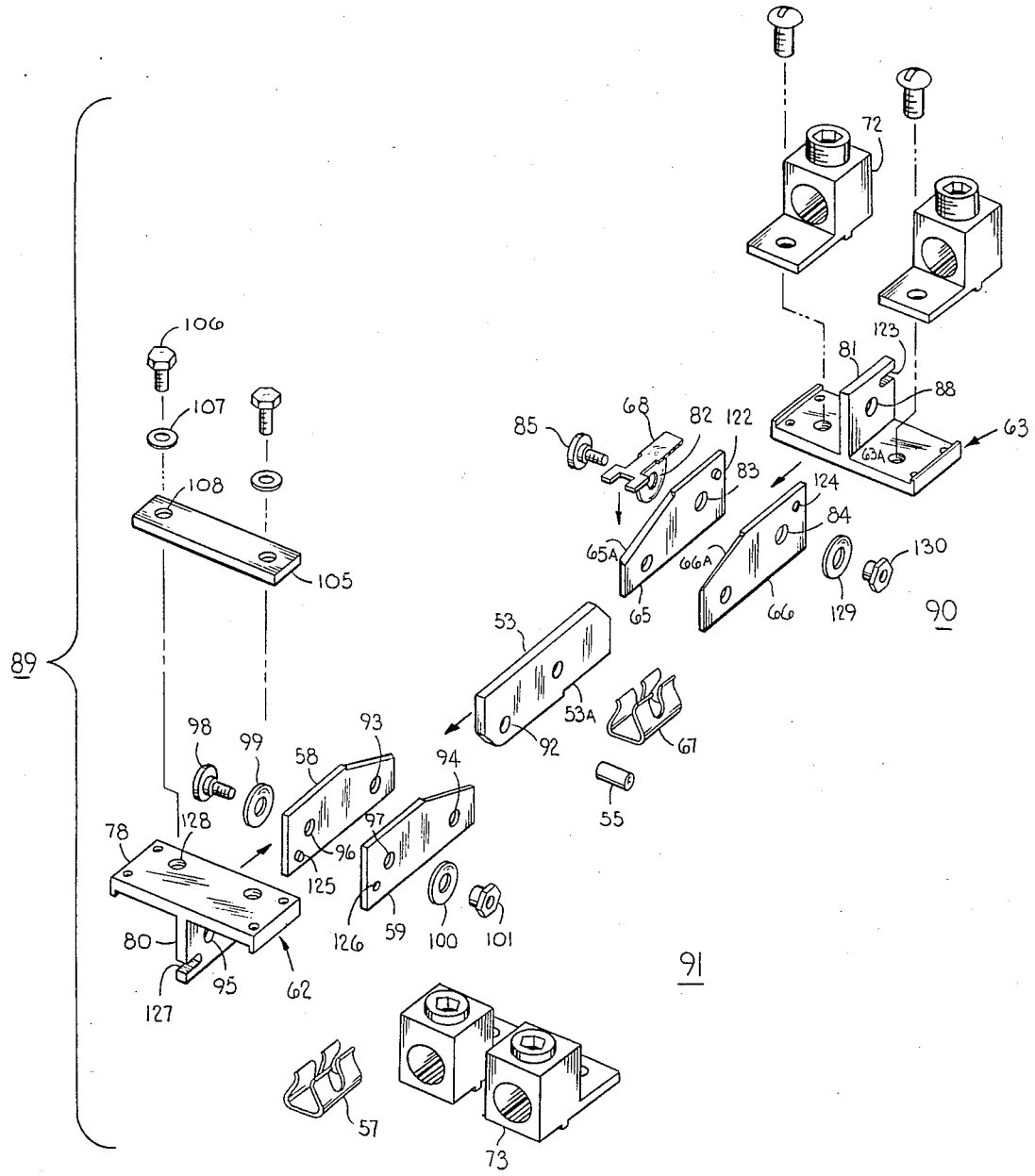
FIG. 3 is a top perspective view in isometric projection of the components that make up the current path within the switch assembly of FIG. 2.

The current through the switch 19 in FIG. 1, traverses the current path assembly 89 best seen by referring now to FIG. 3. As described earlier, the current path comprises the line strap unit 90 and the load strap unit 91 bridged by the contact blade 53. The line strap unit 90 is assembled around the T-shaped lug adapter 63 to which the side plates 65, 66 are attached along with the arc runner 68 by placing the bolt 85 through the thru-holes 82, 83, 84, 88 formed within the arc runner, side plates and the vertical plate 81 extending from the planar surface 63A of the T-shaped lug adapter 63 and attaching washer 129 and nut 130 thereto. The side plates 65, 66 are provided with bevelled surfaces 65A, 66A to facilitate the insertion of the edge 53A of the contact blade 53 and a projection 122 is formed on the inner surface of side plate 65, which extends through a slot 123 formed in the vertical plate 81 and an opening 124 formed in the other side plate 66 to locate the side plate in the exact location on the T-shaped lug adapter 63. The vertical plate 81 precisely sets the spacing between the side plates for receiving the contact blade edge 53A while the contact clip 67 insures good electrical continuity between the side plates and the contact blade 53 as described earlier. The end of the contact blade 53, opposite the contact blade edge 53A, is pivotally arranged between the opposing side plates 58, 59 and is pivotally attached thereto by means of thru-holes 93, 94 through their respective side plates 58, 59 and the thru hole 92 within the contact blade 53 and by means of the pivot pin 55. The side plates 58, 59 are attached to the T-shaped lug adapter 62 by positioning on either side of the vertical plate 80 and the exact positioning of the plates on the T-shaped lug adapter 62 is insured by means of the projection 125 on side plate 58, slot 127 formed on the vertical plate 80 and thru-hole 126 within the side plate 59. The spacing between the side plates is governed by the thickness of the vertical plate 80 and the side plates are attached to the vertical plate by means of openings 96, 97 in the side plates, thru-hole 95 formed within the vertical plate and by means of bolt 98, washers 99, 100 and nut 101. To insure good electrical continuity between the side plates and the contact blade 53 a contact clip 57 is arranged over the side plates in the manner similar to that described with respect to the contact clip 67 used with the line strap unit 90. A pair of load lugs 73 can be attached to the horizontal plate 78 for an unfused current path or alternatively, a fuse clamp 105 can be attached to the horizontal plate 78 by means of bolts 106, washers 107, thru-holes 108 in the fuse clamp 105 and threaded openings 128 formed within the horizontal plate 78.

The current path assembly 89 depicted in FIG. 3, when assembled, replaces a fused and non-fused disconnect switch rated at 600 amperes, 240 volts, as described earlier and as shown for example in U.S. Pat. No. 3,211,867 and for a fused and non-fused disconnect switch rated at 600 amperes, 600 volts, which have similar operating components but which are oversized to meet the increased voltage rating. The total number of parts for each switch is approximately the same and the number of "unique" parts, that is, parts that are different in size and shape is approximately 76. The number of parts required to manufacture the electric switch according to the instant invention is approximately the same as for either the 240 volt or 600 volt switches rated at 600 amperes. However, the number of unique parts for the switch of the instant invention is only 27 compared with 270 total unique parts for the 240 volt and 600 volt switches. By comparing the line and load lugs 72, 73, T-shaped line and load lug adapters 62, 63 and line and load contact clips 57, 67 it is noted that the parts are identical and hence substantially simplify both the inventory and assembly requirements. Side plate 66 is the mirror image of side plate 59 while the side plate 65 is the mirror image of side plate 58 thereby reducing the total number of such parts to be inventoried by 50 percent.

It has thus been seen that by designing an electric disconnect switch having multi-functional components, that a substantial savings in the economics of the manufacture and inventory of the switch component parts can be realized.

Having thus described my invention, what I claim as new and desire to secure by Letters Patent is:

1. A modular electric disconnect switch comprising:

a molded plastic support base;

a line terminal assembly at one end of said base;

a load terminal assembly at an opposite end of said base;

a contact blade extending between said line and load terminal assemblies;

an operating mechanism connecting with said contact blade for electrically connecting and disconnecting said contact blade from said line and load terminal assemblies, said line and load terminal assemblies having interchangeable components;

said load terminal assembly comprising a T-shaped load terminal support adapter interposed between a first pair of side plates at one end of said side plates, with one end of said contact blade being pivotally attached to said side plates at an opposite end of said side plates;

said line terminal assembly comprising a T-shaped line terminal support adapter interposed between a second pair of side plates at one end of said side plates for providing a contact blade receiver slot at an opposite end thereof;

an arc chute arranged on top of said T-shaped line terminal support adapter; and an arc runner attached to a top of said T-shaped line terminal support adapter intermediate said T-shaped line terminal support adapter and said arc chute.

2. The modular disconnect switch of claim 1 wherein said T-shaped load terminal support adapter includes a horizontal part and a vertical part perpendicular to said horizontal part, said horizontal part being supported on a pair of shelves integrally formed within said support base.

3. The modular disconnect switch of claim 2 wherein said T-shaped load terminal horizontal part supports a pair of load terminal lugs on one surface thereof.

4. The modular disconnect switch of claim 2 including a first contact clip arranged around said first side plates and said contact blade end for providing good electrical connection between said contact blade end and said first side plates.

5. The modular disconnect switch of claim 1 wherein said T-shaped line terminal adapter is transposed with respect to said T-shaped load terminal adapter.

6. The modular disconnect switch of claim 1 wherein said first pair of side plates is transposed with respect to said second pair of side plates.

7. The modular disconnect switch of claim 1 further including a second contact clip arranged around a bottom of said blade receiver slot to provide good electrical connection between said second pair of side plates and said contact blade when said contact blade is inserted therein.

8. The modular disconnect switch of claim 1 wherein said T-shaped load terminal support adapter includes a horizontal part and a vertical part perpendicular to said horizontal part, said horizontal part being attached to a bottom of said support base.

* * * * *